United States Patent [19]

Wyson et al.

[11] Patent Number: 5,015,021

[45] Date of Patent: May 14, 1991

[54] TRASH DUMPSTER LOCK WITH GRAVITY OPERATED RELEASE

[76] Inventors: Daniel Wyson, 11637 S. High Mountain Dr., Sandy, Utah 84092; Travis L. Hendrickson, 45 E. 600 North, Logan, Utah 84321

[21] Appl. No.: 472,040

[22] Filed: Jan. 30, 1990

[51] Int. Cl.[5] ..... E05C 3/00

[52] U.S. Cl. ..... 292/230; 294/68.26; 414/414

[58] Field of Search ..... 294/68.26; 414/407, 414/414; 292/230, 231, 131

[56] References Cited

U.S. PATENT DOCUMENTS

| | | | |
|---|---|---|---|
| 3,136,437 | 6/1964 | Shimmon | 414/414 |
| 3,709,389 | 1/1973 | Steltz | 414/408 |
| 3,954,172 | 5/1976 | Rinella | 292/131 |
| 4,088,071 | 5/1978 | Cruse et al. | 294/68.26 |
| 4,155,584 | 5/1979 | Pracchia | 414/414 X |
| 4,182,530 | 1/1980 | Hodge | 294/68.26 |

*Primary Examiner*—Eric K. Nicholson

[57] ABSTRACT

A lock for dumpsters having a free-swinging weight with an attached hook all of which is enclosed in a steel box and mounted inside a trash dumpster. A hanging chain is mounted to a steel plate which in turn is mounted to the lid of the dumpster in such a way as to hang in position where it will be grasped by the aforementioned hook when the lid is closed. Mounted outside the dumpster is a steel plate with a hole drilled such that it will line up with a bar and dowel mechanism mounted on the turning axis of the weight. By inserting a specially made key from the outside through this hole, the dowel may be turned which rotates the weight and releases the chain so the dumpster lid may be opened. In the case of key duplication a standard padlock will restrict the use of any key. A tipping of the dumpster, as occurs when a trash truck dumps it, will rotate the weight by gravity and thus release the chain and open the lid so the load will fall out into the truck. Placing the dumpster back on level ground will automatically relock the lid by engaging once more the chain and weight hook. The weight may also be locked open.

1 Claim, 4 Drawing Sheets

TRASH DUMPSTER LOCK WITH GRAVITY OPERATED RELEASE

BACKGROUND

1. Field of Invention

This invention relates to trash dumpsters, specifically to a mechanism for locking the dumpster lids.

2. Description of Prior Art

Heretofore, owners and renters of trash dumpsters have used their own ingenuity in attempting to lock their dumpsters to avoid unwarranted dumping since no company currently markets a standard system. Generally a chain or some other form of mounting bracket is welded to the dumpster and a padlock is attached. In some case one lock will service both lids (most dumpsters have two lids) or sometimes each lid has its own lock. Some have installed a steel bar across the top of the dumpster to restrain the lids when locked.

These various, mostly homemade, locking system have a major inconvenience in that they require that either the owner remember to unlock them on trash collection day so that they can be dumped, or else the collection company must be provided with a key. Trash collection companies do not like to be bothered with carrying several keys and often the dumpster user forgets to unlock the can. It also creates a problem when the collection company forgets to re-lock the dumpster or loses the lock. It is often the case that after several missed collection days due to a locked dumpster, the lock is removed of simply not used.

The present invention was designed to allow the user to lock the dumpster to prevent unwarranted dumping or scavenging, while at the same time allowing the collection company to dump the can without needing to unlock it first. No prior art exists of a dumpster lock which unlocks itself automatically when the dumpster is dumped and then re-locks after dumping.

U.S. Pat. No. 3,954,172, a bait box, by Anthony J. Rinella operates on somewhat the same principle but is insufficient for our current use. His bait box uses a cylinder with a notch in the top to catch a latch hanging down from the lid. When the box is set upright, the cylinder turns by gravity and hols the lid in place until the box is set on its side again. This sytem is designed differently than ours and does not accomplish the desired results because it requires total manual operation and precise positioning to colse or open the lid. It also lacks a separate mechanism for opening the lid without turning the box as would be required in a dumpster so that the dumpster could be opened by its owner without tipping it.

If there were upward pressure on the lid of the bait box the cylinder would jam and not open whereas our invention will operate effectively even under high pressure from an overloaded dumpster.

The bait box is designed solely to prevent the lid from opening while the box is being carried. Our invention prevents unauthorized entry, allows for authorized entry, opens itself when tipped under all conditions, and re-locks itself when returned to an upright position. It is the first of its kind in the industry.

OBJECTS AND ADVANTAGES

Accordingly, several objects and advantages of our invention are:

(a) to provide a dumpster locking system that allows the user sole access but will also open itself when dumped and re-lock afterwards;

(b) to provide a dumpster locking system that prevents unwarranted use of the dumpster;

(c) to provide a dumpster locking system that frees the user from the need to unlock the dumpster on collection day;

(d) to provide a dumpster locking system that permits the collection company to dump a locked dumpster without unlocking it;

(d) to provide a dumpster locking system that will open itself even if it is under upward pressure from overloaded trash; and (e) to provide a dumpster locking system that eliminates the possibility that the trash collection company might forget to re-lock the dumpster or lose the lock.

DRAWING FIGURES

FIG. 2 shows a front view and demonstrates the movement of the weight as the lock is tipped.

FIG. 3 shows a side view which gives a clearer look at how the key engages.

FIG. 4 is a top view to show that the chain hook is angled in its resting position.

REFERENCE NUMERALS IN DRAWINGS

Figure 1B:
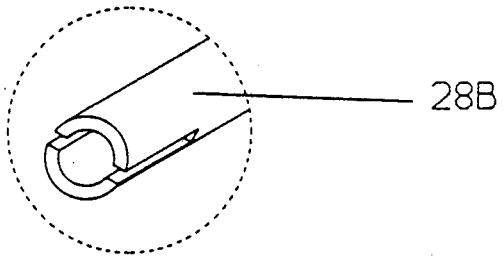
FIG. 1 shows an isometric exploded view of the entire lock.
Figure 1A:
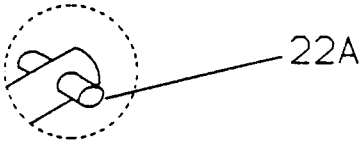

21 main box
22 chain hook
22A dowel
23 center partition
24 weight
25 back plate
26 lock plate
27 sleeve
28 key
28A key handle
28B key shaft
29 chain plate
30 top mounting plate
31 chain

DESCRIPTION FIGS. 1 TO 4

Figure 1:
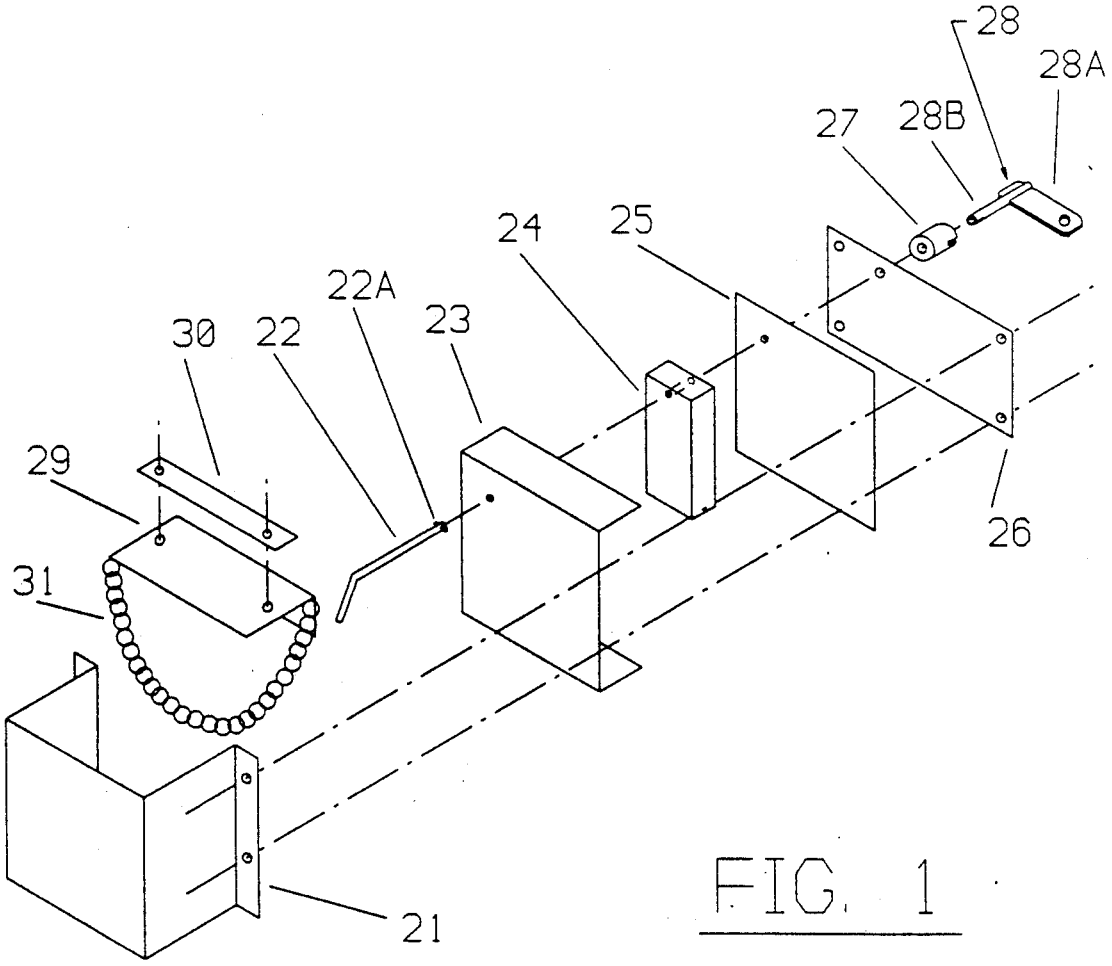

A typical embodiment of the present invention is illustrated in FIG. 1 (isometric exploded view). Main box 21 is made from 2.1 mm (0.083") thick steel with dimensions of 152.4 mm (6") in height and 406.4 mm (16") in total length prior to bending. Bends are made at 90 degree angles as shown in FIG. 1 so as to produce two equal side flaps roughly 25.4 mm (1") in width. Each side flap is drilled with two 9.5 mm (0.375") holes for mounting to lock plate 26. These are drilled on center, the first being 50.8 mm (2") from the bottom of the box and the second 127 mm (5") from the bottom. It is important that the holes in the main box and lock plate 26 match precisely. Positioning of the mount holes is not so critical so long as they match up.

Two more bends are placed in the box about 101.6 mm (4") in from side flap bends creating a center section about 152.4 mm (6") square and two parallel and equal side sections.

Chain hook 22 is 6.3 mm (0.25") diameter round steel in length roughly 100 mm (4") with a 45 degree bend 50.8 mm (2") from one end. Four millimeters from the horizontal end is mounted a steel dowel 22A. The dowel is 2 mm thick and 12 mm long and is press fitted into a hole in the hook so as to protrude an equal distance on each side. FIG. 1 shows a close-up view of this dowel. The hole where the dowel fits throug the shaft of the chain hook 22 is perpendicular to the axis of said shaft. This hole is drilled in such a way that it is horizontal when the shaft is horizontal and the hook part of chain hook 22 is turned up 45 degrees above its lowest possible point. The dowel should not be inserted until after the chain hook 22 is inserted through a hole in center partition 23, through a hole in weight 24, and through a hole in back plate 25.

Center partition 23 is made of steel 2.1 mm (0.083") thick by 152.4 mm (6") wide so that it fits tightly into the main box 21. Its total length before bending is 250 mm (9.83") and then 90 degree bends are made to create two equal side flaps of 47.6 mm (1.875") each with both facing the same direction. A 6.7 mm (0.266") diameter hole is drilled as illustrated in FIG. 1 in the top left corner of partition 23 exactly 123.8 mm (4.875") from the bottom and 28.6 mm (1.125") from the left. This hole will line up with matching holes in weight 24, back plate 25, and lock plate 26. If they do not line up then the invention will not operate propely.

Weight 24 is made of steel and is 120.6 mm (4.75") long and 50.8 mm (2")×25.4 mm (1") wide. Three mm from the top on center is drilled a 6.4 mm (0.25") hole cutting through the thinnest width (25.4 mm). In the top of the weight a 3 mm hole is drilled on center and being 4 mm deep.

Back plate 25 is flat steel being 2.1 mm (0.083") thick in dimensions 150.3 mm×152.4 mm (5.917"×6"). An 6.7 mm (0.266") hole is drilled in this plate matching in location the hole in partition 23 (121.7 mm from the bottom and 28.6 mm from the side).

Lock plate 26 is made of 3.0 mm (0.120") thick steel and in dimensions is 101.6 mm (4")×203.2 mm (8") . Four 9.5 mm (0.375") holes are drilled corresponding to identical holes in the main box 21 when the sleeve 27 is exactly aligned with the chain hook 22. The top of the lock plate is mounted 12.7 mm (0.5") lower than the top of the main box 21. Therefore, the upper holes are centered 12.7 mm (0.5") from the top of the lock plate and 12.7 mm (0.5") from the sides. The lower holes are centered 88.9 mm (3.5") from the top of the lock plate and in 12.7 (5") from the sides. All these mounting holes are 9.5 mm (0.375") in diameter. A fifth hole 9.9 mm (0.391") in diameter is drilled 15.9 mm (0.625") from the top and 53.9 mm (2.125") from the edge as seen in FIG. 1 so that it lines up with matching holes in back plate 25 and center partition 23.

Sleeve 27 steel tubing with an outside diameter of 19 mm (0.75") and the wall thickness being 4.6 mm (0.18"). This tube is welded to the lock plate 26 aligned with the 9.9 mm (0.391") hole in the lock plate 26 as shown in FIG. 3. The length is 25.4 mm (1"). A notch is cut horizontally, perpendicular to the axis, in the outer end of the sleeve 27. The entire width of the tube is notched as shown in FIG. 3. The dimensions of the notch are 4 mm (0.156") wide by 6.4 mm (0.25") deep. A vertical hole is drilled through the sleeve 27 at 12.7 mm (0.5") from the end. This hole has a 7.9 mm (0.312") diameter.

Key Shaft 28B has a 9.5 mm (0.375") outside diameter with a 1.2 mm (0.049") wall thickness. It is 63.5 mm (2.5") long. In each end there is a slot 3.2 mm (0.125") wide. The slots are perpendicular to each other. Each slot bisects thhe tube axially. The slot in the left end (left as in FIG. 3) protrudes into the shaft 28B 9.5 mm (0.375"). The slot in the opposite end protrudes into the key shaft 28 25.4 mm (1").

Key Handle 28A is made of steel having dimensions 3.0 mm (0.120")×25.4 mm (1")×50.8 mm (2"). The key handle 28A fits in the slot on the key shaft 28B with the key shaft 28B centered 12.7 mm (0.5") from the end of the key handle 28A. It is welded into key shaft 28B (FIGS. 1 and 3).

Chain Plate 29 is 3 mm (0.120") thick steel about 152.4 mm (6") long and 114.3 mm (4.5") wide before bending. It is bent giving a 38.1 mm (1.5") vertical part and a 76.2 mm (3") horizontal part both being 152.4 mm (6") long. Two 9.5 mm (0.375) holes are drilled at each end 25.4 mm (1") from the edges and centered with regard to the width of the horizonal part. Top mounting plate 30 is 152.4 mm (6") long and 25.4 mm (1") wide with 9.5 mm (0.375") holes drilled on center corrrsponding to those on the chain plate.

Chain 31 is a #2 twist link chain (machine chain). Chain 31 is attached to the horizontal part of the chain plate 29 on opposite corners as shown in FIG. 1. The chain is welded directly to the chain plate 29 in one corner and in the other corner it is attached to any commercial connecting link or shackle. This connecting link or shackle is welded to the chain plate in that corner.

ASSEMBLY

Back plate 25 is inserted between the two bent flaps of center partition 23 and welded together leaving a 31.7 mm (1.25") space between them as shown in FIGS. 1, 3 and 4. The weight is inserted between the center partition 23 and the back plate 25. Chain hook 22 is inserted through the center partition 23, weight 24, and back partition 25. The weight 24 is then fastened to the chain hook 22 with a spot weld through the hole in the top center of the weight 24 (FIG. 4). The weight 24 is attached to the chain hook 22 in such a way that when the weight 24 is vertical the lowest part of the hook is turned up 45 degrees. The dowel pin 22A is then pressed into the chain hook 22 (FIG. 4). This unit (center partition 23, weight 24, back plate 25, chain hook 22, dowel 22A) is inserted into main box 21 as shown in FIGS. 1 and 4. The partition is welded in plate leaving a 50.8 mm (2") space between the main box 21 and the center partition 23.

The sleeve 27 is aligned with the top hole in lock plate 26 and welded into place as shown in FIGS. 1, 3, and 4. The notch in the shaft should be horizontal.

When mounted to a trash dumpster, the dumpster wall will lie between lock plate 26 and back plate 25. Chain plate 29 is mounted to the dumpster lid such that the outermost edge of the chain plate 29 is located 36 mm (1.416") in from dumpster wall. The chain plate 29 is lined up in the other direction by centering the parabolic shape of the hanging chain 31 with the center of the chain hook shaft 22. The chain 31 hangs down and hooks around the chain hook 22 in the closed position.

The key 28 is made by inserting key handle 28A into key shaft 28B and welding it into place so that one end of handle protrudes 7.9 mm (0.312").

OPERATION

When trash dumpster is closed the chain 31 will catch on the chain hook 22 and hold the lid closed as shown in FIG. 3. As the dumpster is tipped by the disposel company for dumping, the weight 24 will swing forward as shown in FIG. 2 and thus the chain hook will release the chain so that the dumpster lid may open. When the dumpster is replaced in its upright position, the locking system will re-lock the dumpster automatically.

To open the dumpster for use, simply insert the key through the sleeve 27 and turn one quarter turn. There is a notch in the sleeve where the key may be hooked to keep the lock permanently open.

In the case that the key is duplicated, a standard padlock is placed through hole in sleeve 27 (FIG. 4) to restrict the use of any key.

SUMMARY, RAMIFICATIONS, AND SCOPE

Accordingly, the reader will see the advantages of this lock. It permits the user to have private access to their dumpster while removing the need to give a key to the disposal company or for the user to leave the lid unlocked on trash day. This will save the user money by preventing unauthorized use while also saving him the hassle normally associated with putting a standard lock on a dumpster.

This lock is designed so that it will fit almost any existing square-sided dumpster. The chain 31 can be made of differrent lengths to suit the dumpster user depending on how long he needs it to be. FIG. 3 shows how the chain catches on the chain hook when the lid of the dumpster is closed.

Although the description above contains many specifications, these should not be construed as limiting the scope of the invention but as merely providing illustrations of the presently preferred embodiment of this invention. For example, this invention will work though it is composed of different materials or in different sizes, so long as a latching device hangs down from the dumpster lid to engage a free swinging gravity operated locking device mounted on the dumpster, and so long as a mechanism exists to unlock the system manually without dumping.

This lock may be made of different thicknesses, various types of material, such as aluminum or plastic, or different sizes of parts. The sizes represented here were chosen, not because they work better, but because they are more universal in their ability to fit most existing dumpsters and they are made of standard sized material. This may also be designed so that one lock will work on both lids of the dumpster at the same time whereas this invention is designed to work in pairs with a separate lock for each lid. This was done to keep the invention on the side of the dumpster rather than mounting it in front where it might interfere with the dumping of trash.

Thus the scope of this invention should be determined by the appended claims and their legal equivalents, rather than by the examples given.

I claim:

1. A locking device for trash dumpsters comprising;

(a) a two part locking device wherein a top part includes a free hanging latch attached to the underside of a dumpster lid, and a bottom part including a weighted latch attached to a side of a dumpster directly beneath said top part; wherein said top and bottom parts are inaccessible from the outside of said dumpster when said dumpster lid is closed except for a small access hole in the dumpster through which a key type device is inserted;

(b) means by wich said parts are engaged when said lid is closed, and disengaged when said dumpster is tipped by means of the rotation of said weighted latch; (c) means by which said weighted latch may be disengaged from said top latch through manual rotation by one authorized to open said dumpster, wherein rotation is accomplished by use of said key type device inserted through said access hole; and (d) means by which said weighted latch may be locked in the open position.

* * * * *